United States Patent [19]

Mitter

[11] 4,106,407

[45] Aug. 15, 1978

[54] DEFLECTABLE HOLLOW SOCKET SQUEEGEE FOR ROTARY SCREEN PRINTER

[75] Inventor: Mathias Mitter, Schloss Holte, Fed. Rep. of Germany

[73] Assignee: Mitter & Co., Schloss Holte, Fed. Rep. of Germany

[21] Appl. No.: 818,576

[22] Filed: Jul. 25, 1977

Related U.S. Application Data

[63] Continuation of Ser. No. 657,081, Feb. 11, 1976, abandoned.

[30] Foreign Application Priority Data

Feb. 13, 1975 [DE] Fed. Rep. of Germany ..... 2505903

[51] Int. Cl.[2] ..... B41F 15/44

[52] U.S. Cl. ..... 101/120; 29/113 R; 29/116 R

[58] Field of Search ..... 101/119, 120; 29/113 R, 29/113 AD, 116 R, 116 AD

[56] References Cited

U.S. PATENT DOCUMENTS

| | | | |
|---|---|---|---|
| 3,543,366 | 12/1970 | Collet | 29/113 R |
| 3,705,449 | 12/1972 | Kuesters | 29/113 AD |
| 3,779,154 | 12/1973 | Arendt | 29/113 R |
| 3,932,921 | 1/1976 | Biondetti | 29/116 AD |
| 3,934,502 | 1/1976 | Marino | 101/119 |

FOREIGN PATENT DOCUMENTS

| | | | |
|---|---|---|---|
| 1,350,812 | 4/1974 | United Kingdom | 101/120 |

*Primary Examiner*—Ronald E. Suter
*Attorney, Agent, or Firm*—Michael J. Striker

[57] ABSTRACT

A screen printing machine according to the invention has one or more printing stations each provided with a printing screen having a surface adapted to support a printing medium which is to be forced through the printing screen onto a travelling web. A rotary squeegee is provided for forcing the printing medium through the printing screen. The squeegee has a non-rotatable shaft which is mounted so as to be upwardly spaced from and extending substantially parallel to the surface of the printing screen, and a driven tubular jacket which rotatably surrounds the shaft and which is driven in rotation. An arrangement is provided for shifting the squeegee relative to the printing screen surface and into pressure-exerting line contact with the same.

10 Claims, 7 Drawing Figures

DEFLECTABLE HOLLOW SOCKET SQUEEGEE FOR ROTARY SCREEN PRINTER

This is a continuation, of application Ser. No. 657,081, filed Feb. 11, 1976 and now abandoned.

BACKGROUND OF THE INVENTION:

The present invention relates to a screen printing machine in general, and more particularly to a screen printing machine having a rotary-jacket squeegee.

Screen printing machines known in the art either have endless printing screens which are of tubular configuration and which are rotatable, or they have belt-like printing screens which are trained about reversing rollers, or they have flat printing screens mounted in a frame. such machines are used for printing on textiles, paper, non-woven goods and the like.

All screen printing machines have in common that their printing screens are of a very thin material, for example a thin metal foil, a wire mesh or the like, having a very fine perforations therein. A selected printed pattern is produced on to these printing screens by making those portions of the printing screen which are not supposed to print on to a workpiece, inpenetrable to printing ink by coating them with lacquer or in any other manner known in the art. The downwardly facing surface of the printing screen is located above the path of the workpiece onto which it is intended to print. The upwardly facing surface of the printing screen has a printing medium admitted onto it, in the case of tubular rotary printing screens usually by means of an ink-discharging tube. The printing medium, such as ink, which is admitted onto the upper surface of the printing screen is squeezed through the not blocked perforations of the screen by means of a squeegee. Flat squeegees are known which are essentially strip-shaped and wipe over the surface of the printing screen to thus force the printing medium through the screen perforations. Another type of squeegee known in the art is a roller squeegee which is in contact or almost in contact with the upper surface of the printing screen so as to squeeze the printing medium through the perforations of the same. The present invention is particularly concerned with screen printing machines of the type having roller squeegees.

It is known from the prior art to provide a drive for roller squeegees by mounting a gear on the shaft of the squeegee and transmitting motion to the gear. The squeegee may be mounted so that it can be raised and lowered relative to the upper surface of the printing screen in order to be able to vary the gap between the upper printing screen surface and the circumference of the squeegee to thus be able to in turn vary the amount of pressure exerted by the squeegee upon the printing medium that is to be forced through the printing screen. The most common arrangement, however, is to have the squeegee rest under its own weight on the upper surface of the printing screen, i.e. in the case of a tubular printing screen on the inner circumferential surface of the same.

To obtain a uniform discharge of printing ink through the printing screen over the entire length of the roller squeegee, and thus to obtain a uniform printing upon a workpiece web, it is highly important to assure absolutely uniform contact of the squeegee roller periphery with the upper surface of the printing screen, i.e. the inner surface of a tubular printing screen. In cases where direct contact is not desired it is absolutely necessary that the gap defined between the roller squeegee periphery and the surface of the printing screen be uniform over the entire axial length of the roller squeegee.

This has not heretofore been possible.

If the roller squeegee rests under its own weight on the surface of the printing screen and pressure is exerted upon the opposite axial ends of the roller squeegee, this pressure does not cause the center region of the squeegee roller, as seen with reference to the opposite axial ends of the same, to be pressed correspondingly more firmly against the surface of the printing screen. Furthermore, the printing screen is of course itself in contact with the workpiece web, for example a carpet or the like that is to be printed and which has a not inconsiderable ability to yield to pressure by becoming compressed. This means that if, for example in the case of a tubular printing screen, pressure is exerted upon the axial ends of a roller squeegee which extends axially through this printing screen with the intention of pressing the roller squeegee more firmly against the inner circumferential surface of the printing screen, the printing screen is not sufficiently supported in the region of its own axial ends which usually coincide with the axial ends of the roller squeegee. The result of this is twofold, in that downward pressure exerted upon the axial ends of the roller squeegee causes the center region of the squeegee to bow upwardly in direction away from the line of contact with the inner circumferential surface of the printing screen, and in that the rather fragile material of the printing screen itself will be formed with folds or wrinkles in the region of its axial ends where the roller squeegee end portions press firmly upon it, so that in a brief period of time the screen will become destroyed.

What this means is that in the prior art it has heretofore been impossible to exert upon the center region of the squeegee roller any type of pressure urging the same towards the line of contact with the printing screen surface in order to obtain a uniform contact with this surface or a uniform spacing of the squeegee roller periphery from this surface.

SUMMARY OF THE INVENTION

Accordingly, it is an object of the present invention to overcome these disadvantages of the prior art.

More particularly, it is an object of the invention to provide an improved screen printing machine having a roller squeegee provided with an arrangement which makes it possible to assure a uniform pressure of the squeegee roller periphery against the cooperating printing screen surface, or to insure a uniform spacing from that surface.

In keeping with these objects and with others which will become apparent hereafter, one feature of the invention resides in a screen printing machine comprising a combination of a printing screen having a surface adapted to support a printing medium which is to be forced through the printing screen onto a travelling web to be imprinted. Squeegee means are provided for forcing the printing medium through the printing screen. These squeegee means comprise a non-rotatable shaft upwardly spaced from and extending substantially parallel to the printing screen surface, a driven tubular jacket rotatably surrounding this shaft, and means for shifting the squeegee means relative to the surface and into pressure-exerting line contact therewith.

In other words, the roller squeegee according to the present invention is itself constructed as a pressure-exerting roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
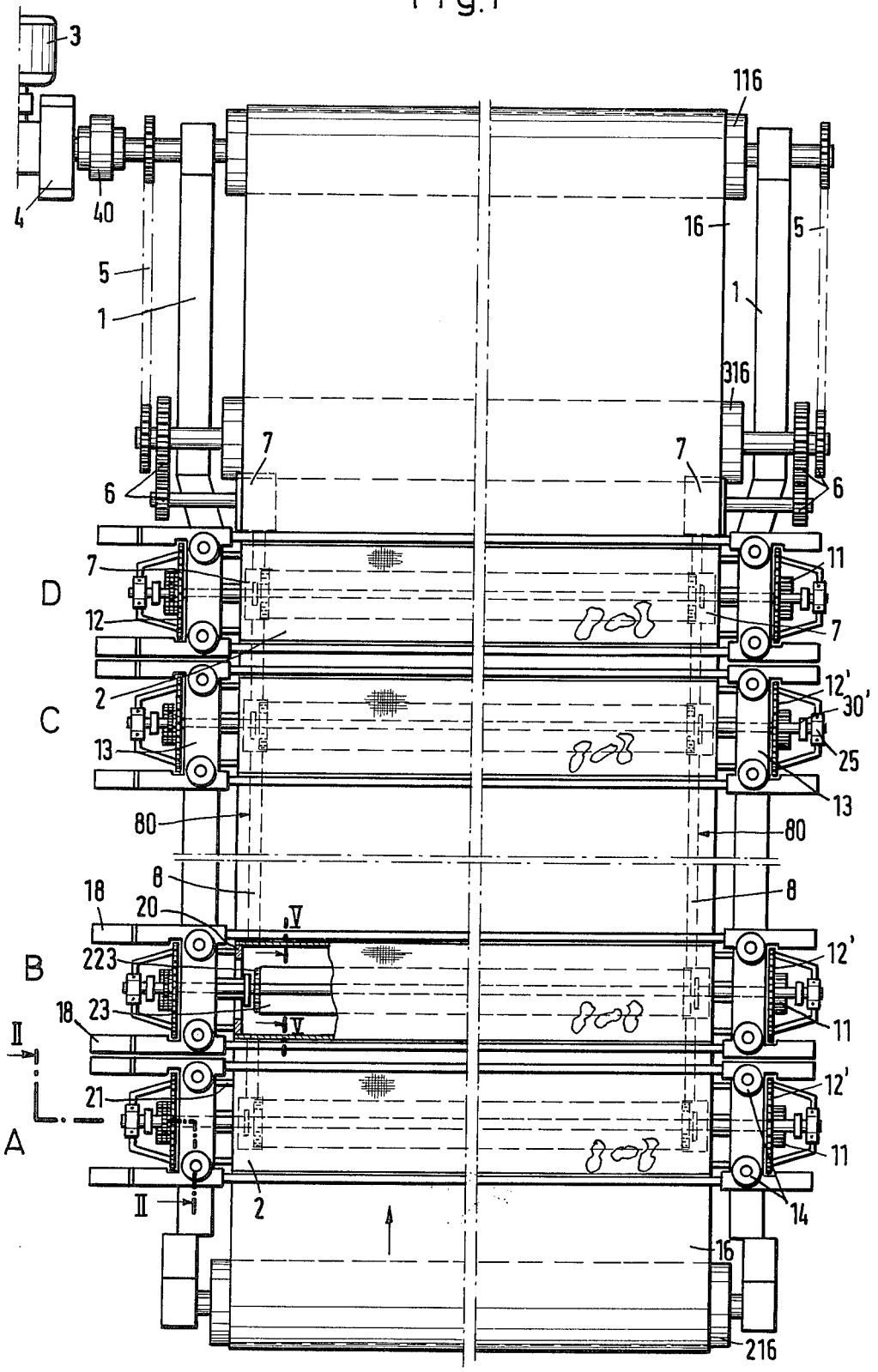
FIG. 1 is a somewhat diagrammatic top-plan view of a screen printing machine according to one embodiment of the invention.
Figure 2:
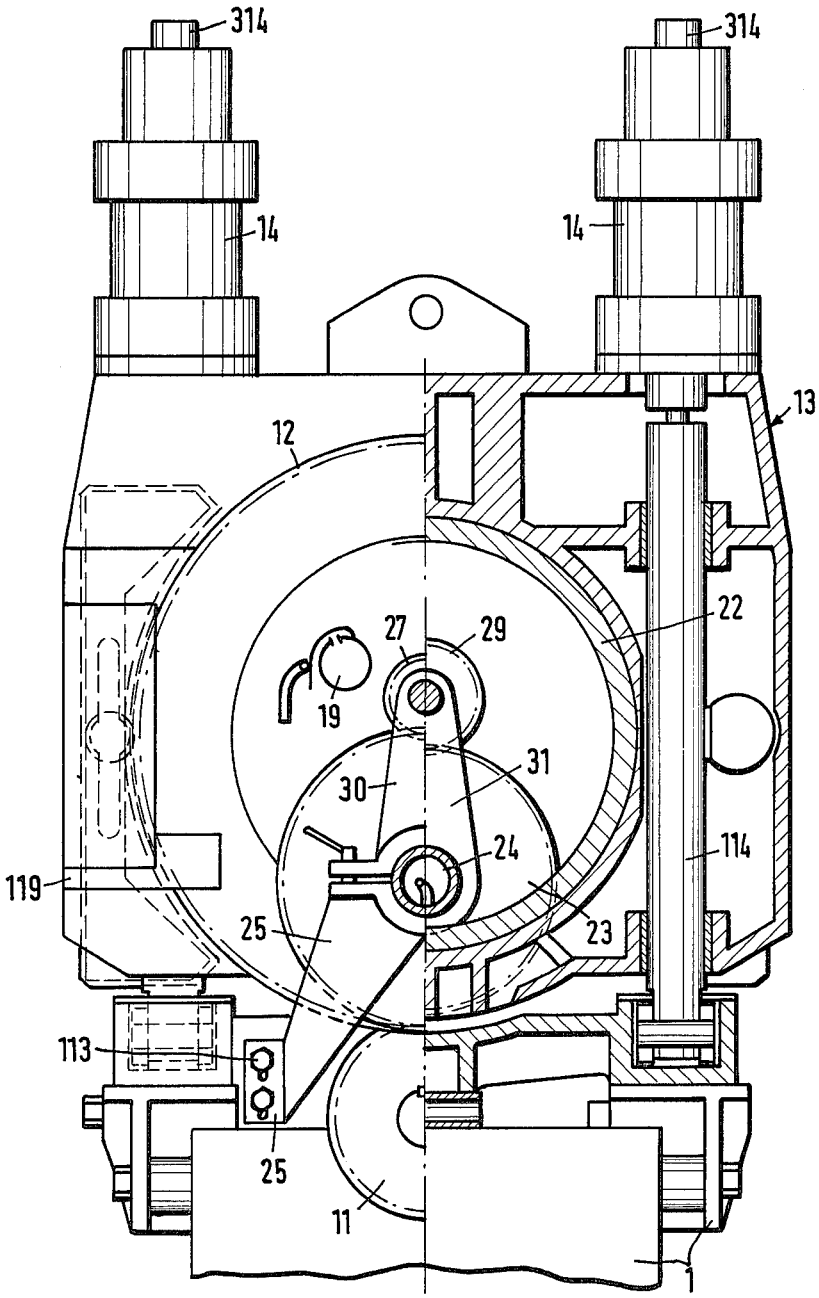
FIG. 2 is a section taken on line II–II of FIG. 1.

A first embodiment of the invention is illustrated in FIGS. 1–5. In these Figures the screen printing machine will be seen to have a machine frame 1 on which there is arranged a series of printing stations A, B, C and D. It should be understood that the number of printing stations could be smaller or larger than the number that is illustrated in the drawing. In the illustrated embodiment each of the printing stations A–D is provided with an endless tubular printing screen 2. As the construction of the several printing stations A–D is identical, the description of the details of a single station will hereafter suffice for an understanding of the invention.

The respective printing screens 2 are driven in rotation via a motor 3 via a transmission 4, a coupling 40, chain drive 5, gears 6 and angle drive 7 which are driven by a main drive shaft 8. In FIGS. 1–5 the main drive shaft and its associated components forms at opposite sides of the machine respective drive trains 80. Drive is transmitted from the angle drives 7 via gears 9, a pair of gears 10 and a gear 11 to a drive gear 12 mounted at each end of the tubular printing screen 2 so that the latter is rotated. The printing screen 2 is mounted on end rings 20 which are provided with connecting bolts 21 by means of which they can be connected to a bearing sleeve 22 which is the actual component that carries at its outer end the respective printing screen drive gear 12.

The bearing sleeves 22 themselves are mounted in adjustable end supports 13 which are each provided with two cylinder-and-piston units 14 that are connected to a fluid source (FIG. 3) and are operable to raise or lower the end supports 13. The latter are adjustable in the direction of advancement of the web 17 to be printed (i.e. normal to the plane of FIG. 3) as well as transversely to this direction, so that a precise positioning and alignment of the printing screen 2 is possible.

The cylinder-and-piston units 14 have pistons 214' which act via piston rods 214 upon upright supports 114 which are constructed to serve as extensions of the piston rods 214. This makes it possible to lift off each printing station in toto upon disconnecting of a few components. It is desirable to be able to provide for a precise adjustment of the end supports 13 and thus the screen 2; for this purpose each piston rod 214 has associated to its upper end a nut 314. By appropriate turning of the respective nut 314 the gap between the outer circumferential surface of the printing screen 2 and the upper table 115 of the counter pressure beam 15 located beneath the printing screen 2, can be precisely adjusted. Through this gap passes the printing blanket 16 which is endless and trained about reversing rollers as known from the prior art, and on top of the printing blanket the workpiece web 17 (FIG. 4), e.g. a rug, a carpet or the like. The reversing rollers 116 and 216 as well as a drive-transmitting roller 316 about which the printing blanket 16 is trained, are shown in FIG. 1.

Figure 5:
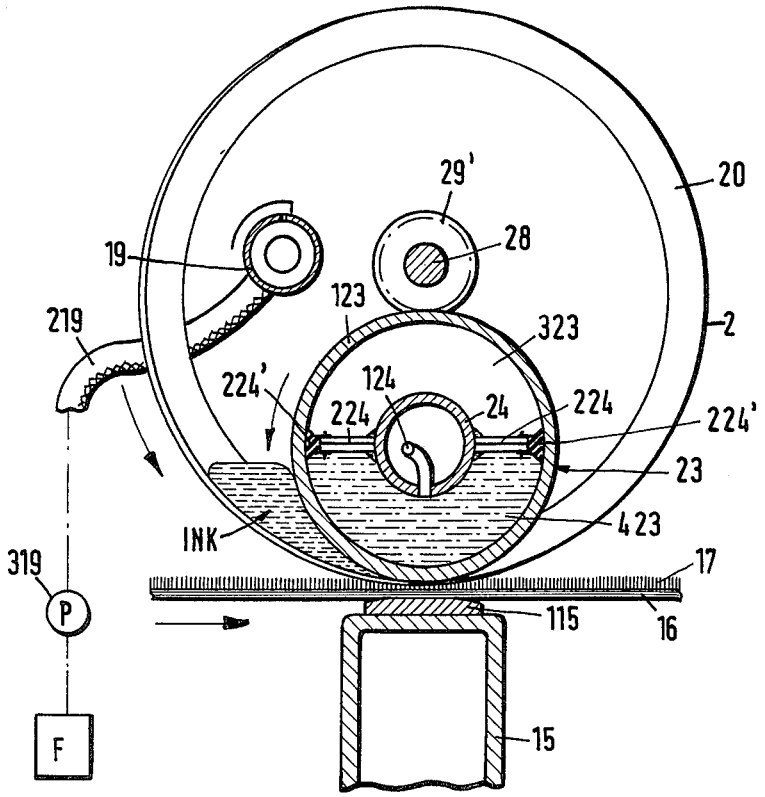
FIG. 5 is a somewhat diagrammatic section taken on line V—V of FIG. 1.

The printing screens 2 are relatively fragile, as has been discussed with respect to the prior art. Despite this it is desirable that it be possible to tension them in axial direction in order to improve the quality of the print that can be obtained. In the illustrated apparatus this is achieved by providing fluid-operated tensioning cylinders 18 at one axial end of the screen 2 which engage the end supports 13. Furthermore, the sleeves 12 of hollow interior construction to permit the convenient introduction of various media to the interior of the printing screen 2. For example, the ink supply tube 19 (not shown in FIG. 1, but see FIG. 2) is supplied from the exterior and is supported on consoles 119 by means of not illustrated retainers at the respective end supports 13. Printing ink is supplied to the ink supply tube 19 via hoses 219, pumps 319 and a respective ink supply F as shown in FIG. 5. The manner in which the ink is supplied to the supply tube 19 has been described only for information and does not form a part of the present invention, being known per se from the prior art.

Details of the roller squeegee 23 according to the present invention are shown clearly in FIGS. 2–5. The roller squeegee is received in the printing screen 2 and extends axially thereof. It has a non-rotatable shaft 24 which extends outwardly past the opposite axial ends of the printing screen 2, through the respective end supports 13 up to support elements 25. The support elements 25 for the shaft 24 are themselves mounted on the end supports 13, and can be vertically adjusted due to the fact that they are provided with vertically extending slots through which bolts 113 are threaded into the end supports 13. Thus, the shaft 24 can be raised and lowered by raising or lowering the support elements 25, or the entire unit can be raised and lowered by raising or lowering the end supports 13 themselves.

Figure 3:
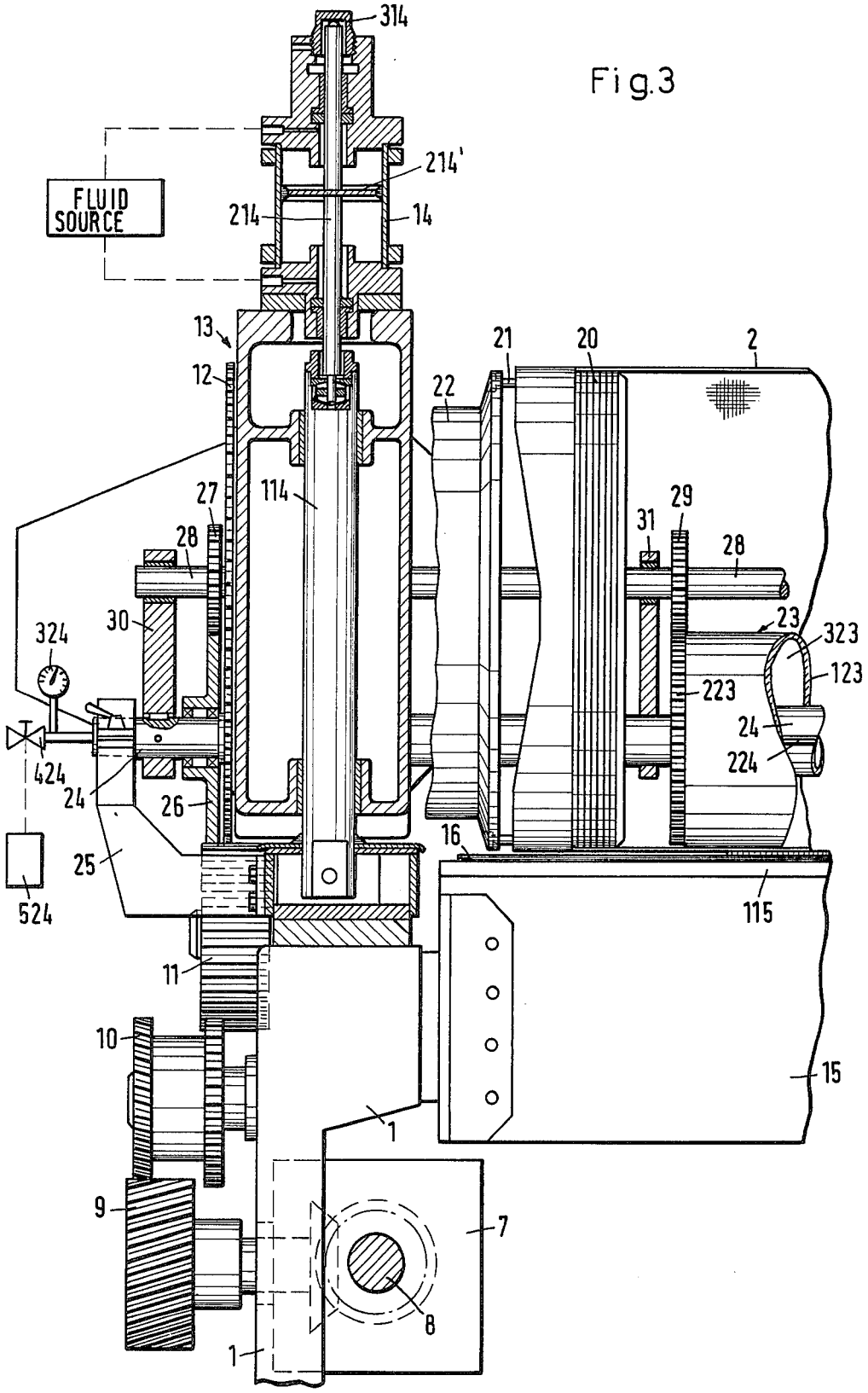
FIG. 3 is a vertical section through a printing station, taken in the region of one axial end of the tubular printing screen thereof.
Figure 4:
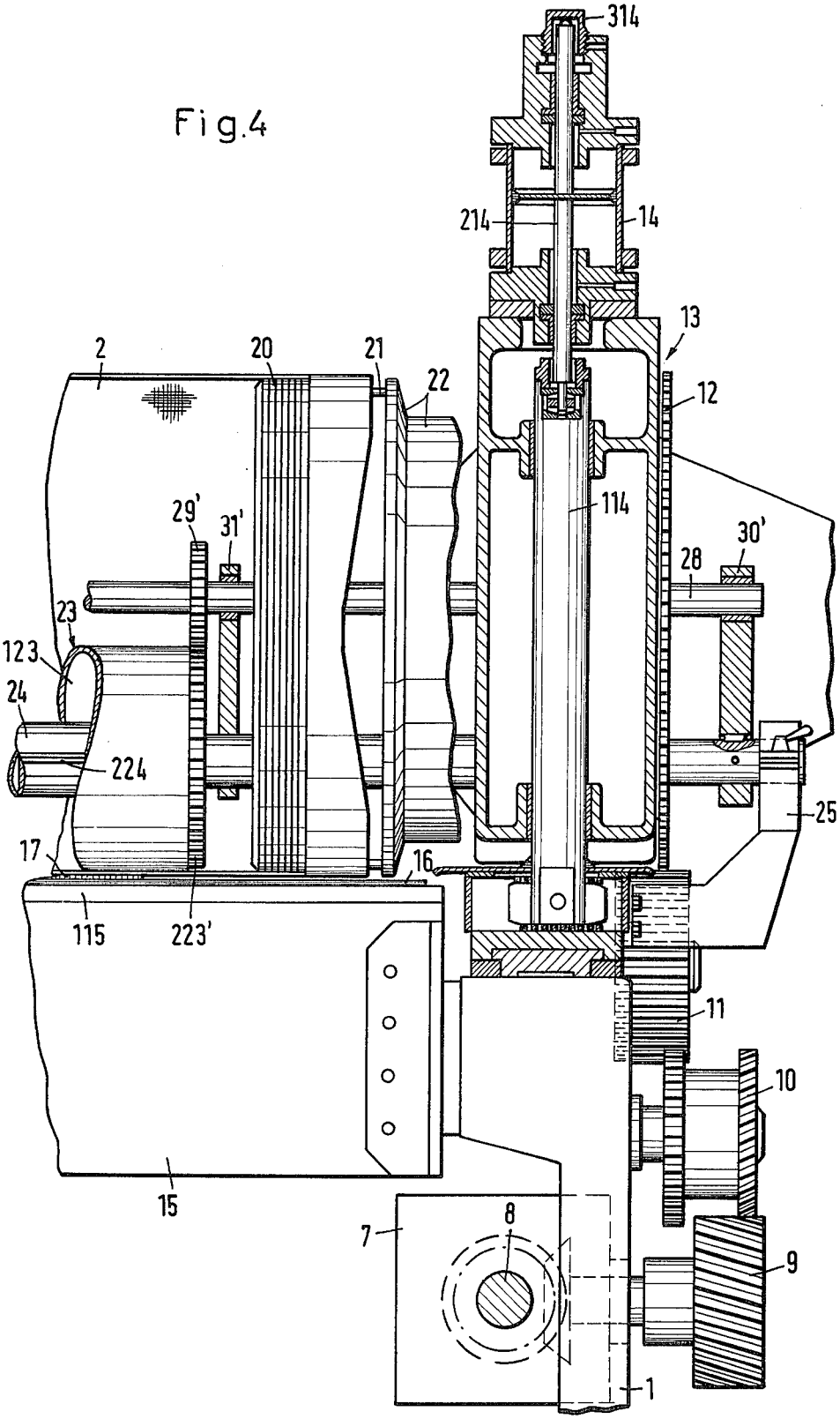
FIG. 4 is a vertical section through the same printing station as FIG. 3, but in the region of the opposite axial end of the printing screen.

The non-rotatable shaft 24 of the roller squeegee 23 is surrounded by a tubular jacket 123 which is provided at its opposite axial ends with annuli of gear teeth, here illustrated as external annuli 223 and 223', respectively. The jacket 423 is composed of steel, iron, polyamid for example. The jacket 123 is to be driven in rotation losely surrounds the shaft 24 whereas the shaft 24 remains stationary. For this purpose the shaft 24 is provided with a gear 26 at one or both sides of the machine where the drive trains 80 are provided. The gear 26 meshes with the teeth of a gear 27 which is mounted on a drive shaft 28 which extends through the interior of a tubular printing screen 2. The shaft 28 also extends through both of the end supports 13 and carries, as illustrated in FIGS. 3 and 4, respective gears 29 and 29' which mesh with the annuli of teeth 223 and 223', respectively, that are provided on the jacket 123. The shaft 28 is fixedly mounted at a predetermined spacing from the shaft 24 by means of two axially outer supports 30 and 30' and two axially inner supports 31 and 31', respectively, as shown in FIG. 3. The shaft 24 is mounted on the supporting elements 25 by means of clamping devices which are adjustable so that it is possible to vary the vertical spacing of the roller squeegee 23 with reference to the inner circumferential surface of the printing screen 2. As indicated before, this variation can be effected by loosening the bolts 113, shifting the members 25 as desired, and then tightening the bolts 113 again.

The roller squeegee 23 is so constructed that it will not bend or flex (i.e. bow) under its own weight. However, as will be presently described, the jacket 123 can be made to become sufficiently deformed so as to accommodate itself, e.g. to a downwardly bowed counter-pressure beam 15. It should be understood that the construction of the roller squeegee need not be identical with what has been illustrated in the drawing by way of example.

In the illustrated example the annular space, defined between the non-rotatable shaft 24 and the rotary jacket 123 is subdivided in longitudinal direction so as to form an upper chamber 323 and a lower chamber 423 (see FIG. 5). The shaft 24 itself is hollow in this embodiment and a pressure medium hose or conduit 124 extends through it which communicates with the lower chamber 423. The subdividing of the space into the chambers 323 and 423 is effected via two transverse partitions 224 which in the illustrated embodiment are mounted on the shaft 24 and which have radially outer edges adjacent the inner circumferential surface of the rotary jacket 123. The partitions 224 are welded or otherwise secured to the shaft 24. The gap between these edges and the inner circumferential surface of the jacket 123 is sealed in appropriate manner, for example by means of the illustrated elastically yieldable sealing strips 224' which may be of a suitable sealing material, for example one of the synthetic plastic materials which are known to those skilled in the art for sealing purposes. The sealing strips 224' sealingty engage the inner circumferential surface of the jacket 123 but do not prevent the latter from rotating.

A pressure medium, for example water, oil, air or a gas is admitted via the conduit 124 into the lower chamber 423 (the chamber is shown filled in FIG. 5) and a pressure measuring device 324 (see FIG. 3) permits the pressure to be ascertained at the exterior. A reducing valve 424 permits the pressure to be controlled, and a pressure source 524 is provided, for example a compressor, which produces the compressed medium.

It is evident that depending upon the extent to which the chamber 423 is pressurized, a uniform pressure is exerted upon the jacket 123 in the direction towards its line of contact with the inner circumferential surface of the printing screen 2. This pressure is, as pointed out, uniform over the entire length of the roller squeegee 23 and eliminates any danger that the squeegee might bow in some portions or that due to uneven pressure by the squeegee upon the printing screen 2 the latter might become damaged. In FIG. 5 the direction of travel of the workpiece web 17, the direction of rotation of the tubular printing screen 2 and the direction of rotation of the rotary jacket 123 of the squeegee roller 23, are all indicated by appropriate arrows. The sump of ink admitted into the interior of the printing screen 2 via the ink supply tube 19, is identified by a legend.

As before described, the particular construction of the roller squeegee 23 that is shown in FIG. 5 is by way of example only. Other parts of constructions will also lend themselves to the purposes of the invention, and for example the squeegee could be constructed in the manner known from calendar rollers used in textile processing, or in other ways, as long as it is assured that the roller squeegee is inherently resistant to bowing and that it can be made to uniformly contact the printing screen surface even in the center region of the squeegee. The squeegee could also be driven in other ways than those described, namely via the annuli of gear teeth 223 and 223'. Either annuli of gear teeth could be used, or axial couplings or the like could be employed, as long as it is assured that the jacket 123 is driven in rotation.

Figure 6:
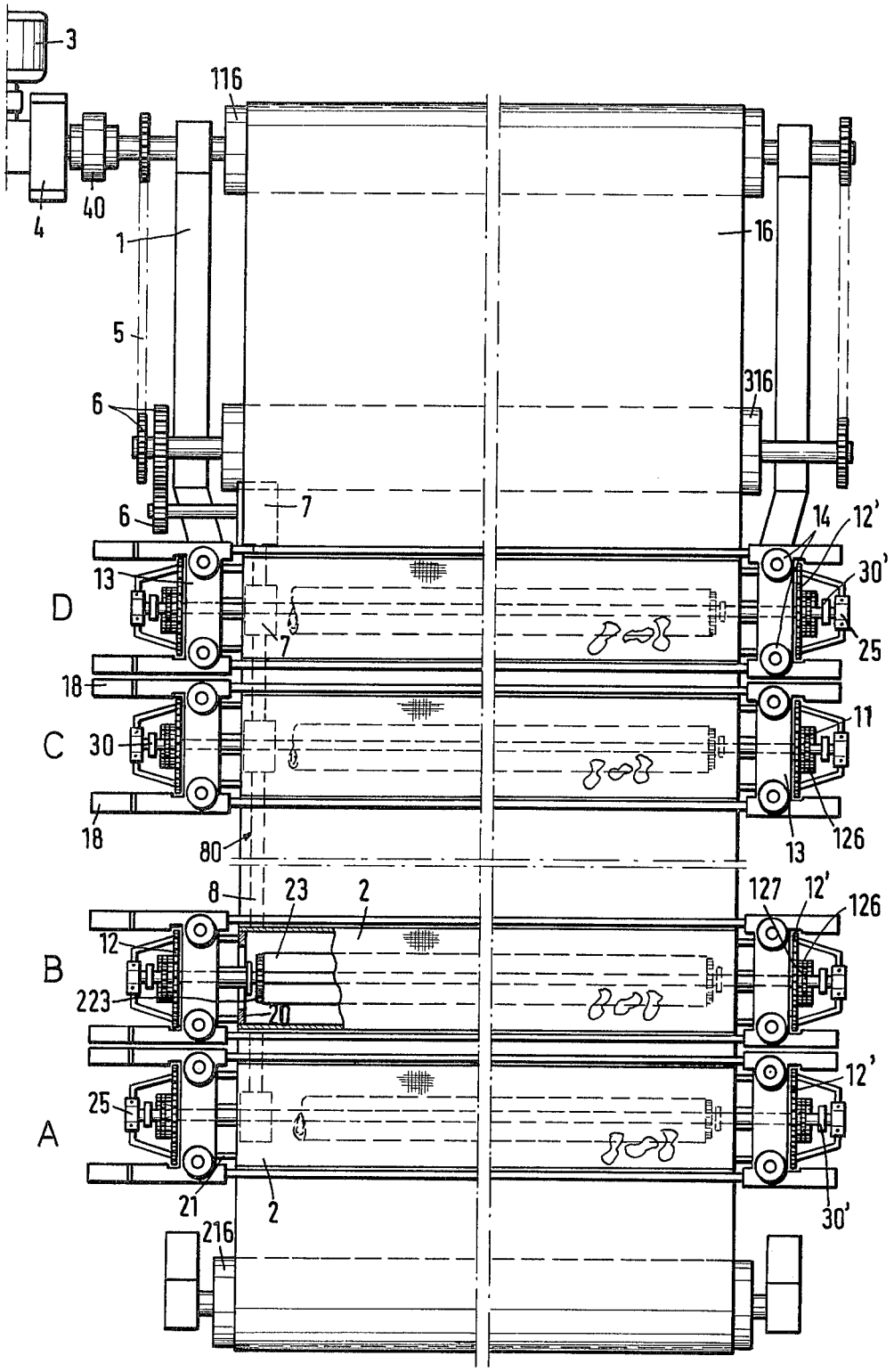
FIG. 6 is a view similar to FIG. 1, but of a machine according to a somewhat different embodiment of the invention.
Figure 7:
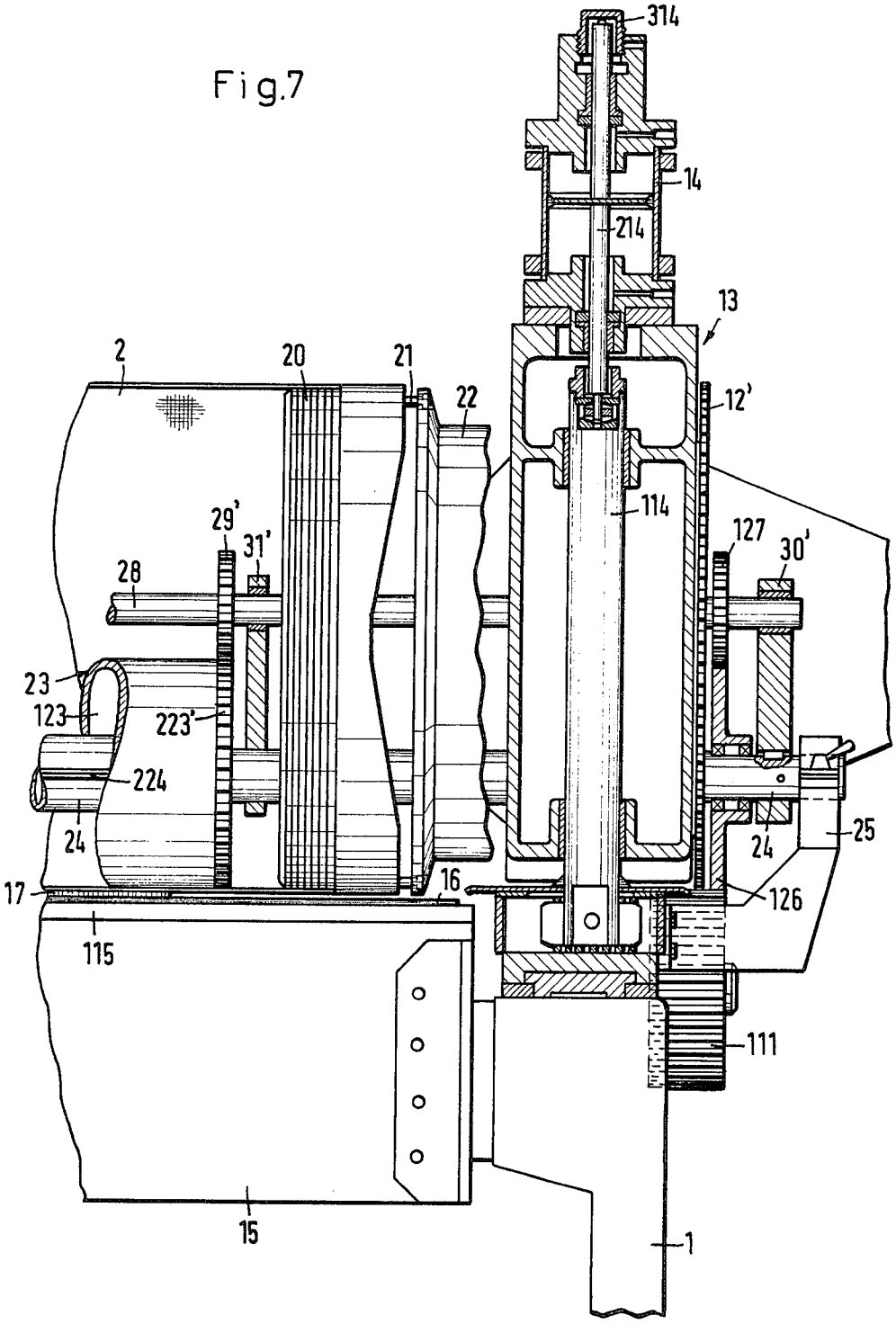
FIG. 7 is a view similar to FIG. 4, but through a printing station of the machine in FIG. 6.

As FIGS. 6 and 7 show, the embodiment illustrated therein is largely the same as in FIG. 1. In fact, FIG. 6 clearly shows that a major difference is that a drive train 80 is provided only at one lateral side of the machine, instead of at both lateral sides as in FIG. 1. At the other side, i.e. the left side in FIG. 6, there is provided an idler gear 111 which meshes with the printing screen gear 12'. The embodiment of FIGS. 6 and 7 makes use of the fact that the drive shaft 28 with its gears 29, 29' extends axially through the interior of the printing screen 2. Thus, in FIGS. 6 and 7 the shaft 28 is used to provide a positive drive for the printing screen 2 even at that side of the machine which does not have a drive train 80.

Adjacent the outer support 30' the shaft 28 carries in the embodiment of FIGS. 6 and 7 an additional gear 127. An idler gear 126 is freely turnably mounted on the non-rotatable shaft 24 and meshes with the shaft 127 as well as with the idler gear 111. The latter in turn meshes with the printing screen gear 12' which transmits rotation to the printing screen 2 via its associated bearing sleeve 22 and the bolts 21. Thus, although in FIGS. 6 and 7 a drive train 80 is provided only at one side of the machine, the printing screen is nevertheless positively driven at both sides of the machine, i.e. at both of its axial ends, thus making it unnecessary to provide additional drive at one side of the machine and simplifying the embodiment of FIGS. 6 and 7 as compared to that of FIGS. 1–5.

The construction of the roller squeegee 23 is of course the same in FIGS. 6 and 7 as in FIGS. 1–5.

In both embodiments the supply of pressure medium to the chamber 423 can be continuously varied. Appropriate pressure in the chamber 423 makes the squeegee inherently resistant to bowing, i.e. bowing cannot occur because of the internal pressure and thus a straight-line contact will always be assured with the inner circumferential surface of the printing screen 2. If desired, however, the internal pressure can be further increased so that, for example in the event that the counter-pressure beam 15 should be downwardly bowed away from the printing screen 2, the jacket 123 can be so pressurized as to conform itself to the deformation of the counter pressure beam 15. This assures an exact parallel operation of the roller squeegee 23 in the interior of the printing screen 2 at all times, so that the wedge-shaped printing medium sump in the interior of the screen 2 (compare FIG. 5) will be absolutely uniform over the entire axial length of the screen and the squeegee. It is of course possible to adjust the arrangement of the invention in such a way that there is no contact between the circumference of the jacket 123 and the inner circumferential surface of the screen 2, but instead that a gap exists between them. Even in such a case the pressurizing capability according to the present invention is highly useful, because it makes it possible to precisely adjust the width of the gap and, due to the thus-obtained gap uniformity to assure a uniformity of the printed pattern.

It will be understood that each of the elements described above, or two or more together, may also find a useful application in other types of constructions differing from the types described above.

Thus, the roller squeegee may be constructed i.e. as shown in: DT-AS1113131 DT-AS 1111932 DT-PS 1026609DT-AS 1411327 DT-AS 2019708 DT-PS 1280035.

While the invention has been illustrated and described as embodied in a screen printing machine having a tubular printing screen, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a screen printing machine of the type having a roller squeegee and wherein the pressure exerted by the center region of such roller squeegee upon the printing machine to be forced through the printing screen of the machine tends to be less than the pressure exerted thereupon by the end regions of the roller squeegee, resulting in non-uniform printing by the machine, a combination comprising a printing screen having a surface for supporting a printing medium which is to be forced through said printing screen onto a travelling web to be imprinted; squeegee means for forcing said printing medium through said printing screen, said squeegee means comprising a non-rotatable shaft upwardly spaced from and extending substantially parallel to said surface, a driven tubular jacket rotatably surrounding said shaft; a drive shaft parallel to said non-rotatable shaft; drive gears on said drive shaft for driving said tubular jacket pairs of axially spaced shaft bearings at opposite end portions of said non-rotatable shaft, journalling said drive shaft and maintaining said shafts at a predetermined distance from each other; and means for shifting said squeegee means relative to said surface, including means for displacing said jacket relative to said shaft in direction towards said surface and for deforming said jacket into conformance with the contour of said surface when the surface is downwardly bowed in direction away from said shaft, so that the pressure exerted by said jacket is always uniform over the axial length of said tubular jacket.

2. In a screen printing machine of the type having a roller squeegee and wherein the pressure exerted by the center region of such roller squeegee upon the printing medium to be forced through the printing screen of the machine tends to be less than the pressure exerted thereupon by the end regions of the roller squeegee, resulting in non-uniform printing by the machine, a combination comprising a printing screen having a surface for supporting a printing medium which is to be forced through said printing screen onto a travelling web to be imprinted; squeegee means for forcing said printing medium through said printing screen, said squeegee means comprising a non-rotatable shaft upwardly spaced from and extending substantially parallel to said surface, a driven tubular jacket rotatably surrounding said shaft and having opposite axial end portions; annuli of teeth on the respective axial end portions; a drive shaft parallel to said non-rotatable shaft; drive gears on said drive shaft and meshing with said annuli of teeth; pairs of axially spaced shaft bearings at opposite end portions of said non-rotatable shaft, journalling said drive shaft and maintaining said shafts at a predetermined distance from each other; and means for shifting said squeegee means relative to said surface, including means for displacing said jacket relative to said shaft in direction towards said surface and for deforming said jacket into conformance with the contour of said surface when the surface is downwardly bowed in direction away from said shaft, so that the pressure exerted by said jacket is always uniform over the axial length of said tubular jacket.

3. A combination as defined in claim 2, wherein said annuli of teeth exteriorly surround the respective end portions.

4. A combination as defined in claim 2, each pair of bearings including an axially outer bearing; and further comprising means at least at one of said axially outer bearings for driving said drive shaft in rotation.

5. In a screen printing machine of the type having a roller squeegee and wherein the pressure exerted by the center region of such roller squeegee upon the printing medium to be forced through the printing screen of the machine tends to be less than the pressure exerted thereupon by the end regions of the roller squeegee, resulting in non-uniform printing by the machine, a combination comprising a printing screen having a surface for supporting a printing medium which is to be forced through said printing screen onto a travelling web to be imprinted; squeegee means for forcing said printing medium through said printing screen, said squeegee means comprising a non-rotatable shaft upwardly spaced from and extending substantially parallel to said surface, a driven tubular jacket rotatably surrounding said shaft and defining therewith an annular space; and means for shifting said squeegee means relative to said surface, including sealing means sealingly subdividing said annular space into an upper and a lower chamber with reference to the longitudinal axis of said non-rotatable shaft and means for displacing said jacket relative to said shaft in direction towards said surface and for deforming said jacket into conformance with the contour of said surface when the surface is downwardly bowed in direction away from said shaft, so that the pressure exerted by said jacket is always uniform over the axial length of said tubular jacket, said displacing means comprising means for producing a cushion of pressure fluid in said lower chamber acting upon said jacket in direction towards said surface of said screen.

6. A combination as defined in claim 5; and further comprising vertically extendable and retractable mounting units supporting said non-rotatable shaft.

7. A combination as defined in claim 6; further comprising adjustable bearings supporting said printing screen at opposite lateral sides of a path in which the web to be printed moves relative to said screen; said mounting units being connected to the respective bearings and said non-rotatable shaft extending through the latter.

8. A combination as defined in claim 7, wherein said screen is an endless annular screen having respective axial end portions each supported by one of said bearings.

9. A combination as defined in claim 5, said non-rotatable shaft having an internal passage, and wherein said means for producing comprises a pressure-fluid conduit in said passage and communicating with said lower chamber.

10. A combination as defined in claim 5; further comprising pressure-fluid supply means communicating with said conduit; and pressure-regulating means interposed in said conduit.

* * * * *